United States Patent [19]

Ohmuro

[11] Patent Number: 4,856,406

[45] Date of Patent: Aug. 15, 1989

[54] TIMPANI

[75] Inventor: Hiroaki Ohmuro, Hamamatsu, Japan

[73] Assignee: Yamaha Corporation, Japan

[21] Appl. No.: 42,717

[22] Filed: Apr. 27, 1987

[30] Foreign Application Priority Data

May 12, 1986 [JP] Japan ..... 61-70002

[51] Int. Cl.[4] ..... G10D 13/04

[52] U.S. Cl. ..... 84/419

[58] Field of Search ..... 84/419

[56] References Cited

U.S. PATENT DOCUMENTS

| | | | |
|---|---|---|---|
| 1,054,009 | 2/1913 | Ludwig | 84/419 |
| 1,755,569 | 4/1930 | Strupe | 84/419 |
| 2,276,846 | 3/1942 | Jeffries | 84/419 |
| 3,021,743 | 2/1962 | Ludwig | 84/419 |
| 3,163,075 | 12/1964 | Toperzer, Jr. | 84/419 |

FOREIGN PATENT DOCUMENTS

| | | |
|---|---|---|
| 53-136815 | 11/1978 | Japan . |
| 57-3027 | 1/1982 | Japan . |
| 57-9828 | 2/1982 | Japan . |

*Primary Examiner*—L. T. Hix
*Assistant Examiner*—Brian W. Brown
*Attorney, Agent, or Firm*—Lerner, David, Littenberg, Krumholz & Mentlik

[57] ABSTRACT

In construction of a timpani, a brake unit is attached to a tonal pitch adjuster unit for balancing moment by head resumption with moment by spring repulsion so that the tonal pitch adjuster unit, i.e. the foot pedal, should be locked against accidental displacement from the position corresponding to the initial stepped angle of the foot pedal due to head striking during performance.

9 Claims, 3 Drawing Sheets

HEAD SURFACE
KETTLE

A
B
II
III

TIMPANI

BACKGROUND OF THE INVENTION

The present invention relates to an improved timpani, and more particularly relates to an improvement in tonal pitch adjustability of a timpani provided with a tonal pitch adjuster unit.

In the general construction of a timpani, a tonal pitch adjuster unit is arranged within a housing below a kettle so as to operate in response to stepping of a foot pedal by a player for adjustment of tonal pitch of sounds. It is required for this tonal pitch adjuster unit to allow the foot pedal to retain the stepped angle even after foot pressure on the foot pedal is removed. To this end, it is proposed in Japanese Utility Model Publication Sho. 57-3027 to use a horizontal balance spring so that moment by spring force should balance with moment by resumption of the timpani head. Through this balance of moment, the foot pedal is able to retain its stepped angle despite removal of foot pressure in order to apply prescribed tension to the head. With this construction, however, there is a demerit that striking of the head during performance causes changes in the retained stepped angle. Such a change in the stepped angle leads to corresponding change in the head tension, thereby causing disorder in musical interval of sounds to be generated.

SUMMARY OF THE INVENTION

It is the object of the present invention to provide a tonal pitch adjuster unit for a timpani which causes no disorder in musical interval of sounds to be generated.

In accordance with the basic concept of the present invention, a tonal pitch adjuster anti for a timpani is accompanied with a brake unit.

DESCRIPTION OF THE PREFERRED EMBODIMENTS

Figure 1:
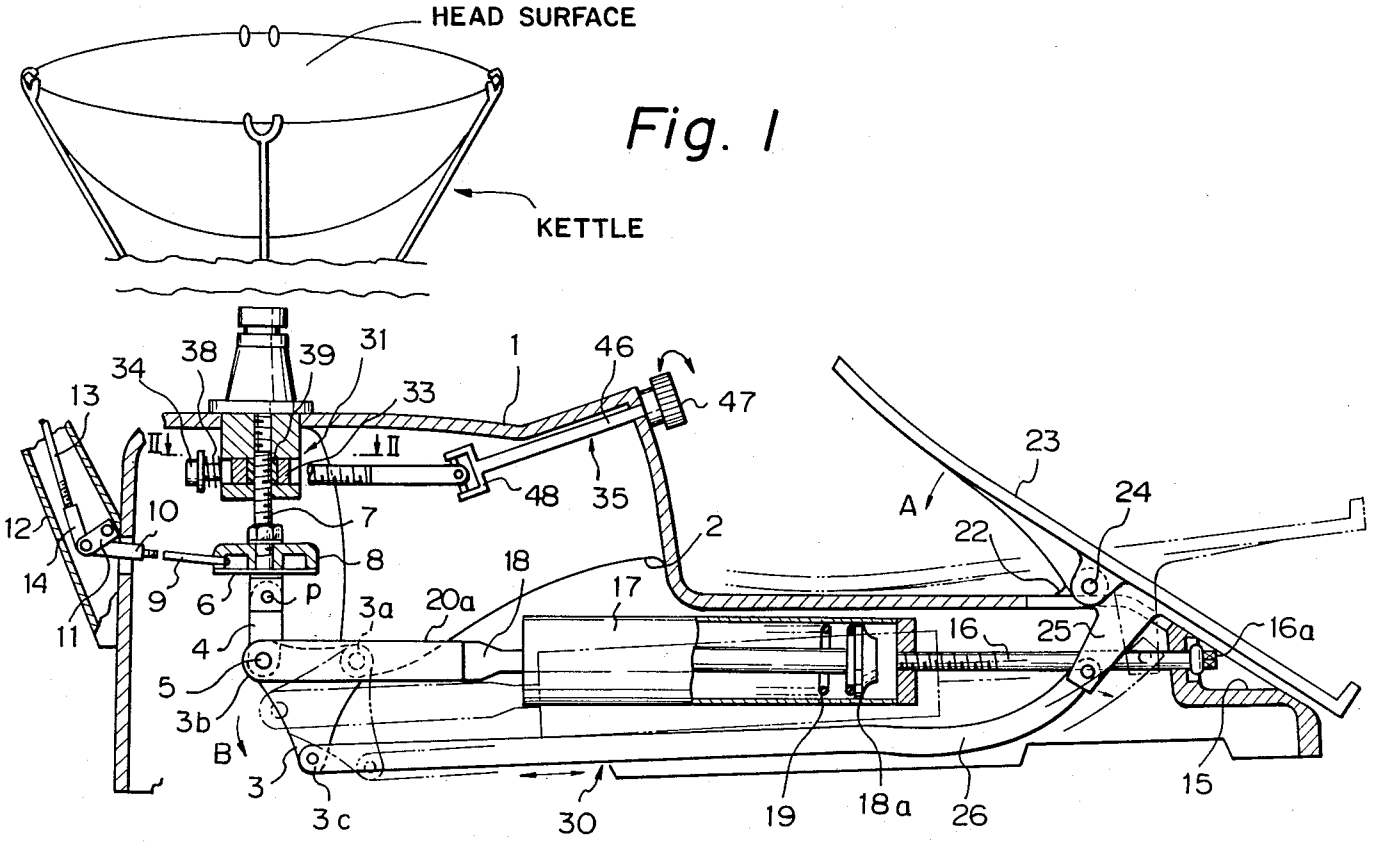
FIG. 1 is a side view, partly in section of one embodiment of the timpani in accordance with the present invention.

The total construction of one embodiment of the timpani in accordance with the present invention is shown in FIG. 1, in which a pan-shaped housing 1 for accommodating a tonal pitch adjuster unit 30 is arranged under a kettle (not shown) and internally provided with a bracket 2 projecting downwards. A center tuning link 3 is coupled at its first pivot 3*a* to one lower corner of the bracket 2. The center tuning link 3 is also coupled at its second pivot 3*b* to the lower end of a center link 4 by a pin 5. The top end of the center link 4 is coupled to a washer 6 by a pin P. The washer 6 securedly holds the lower end of a sliding shaft 7 and a hollow spider nut 8. One end of a tension rod 9 is tiltably coupled to the spider nut 8 whilst extending radially towards the side wall of the housing 1. The other end of the tension rod 9 is coupled to a connector 10 which extends outwards idly through the side wall of the housing 1. A hollow frame 12 is secured to the side wall of the housing 1 at the spot of projection of the connector 10, and a link 11 is pivoted to the inner wall of the frame 12 near the lower end of the latter. The outer end of the connector 10 is pivoted to the link 11. A tuning rod 13 extending through the frame 12 is also pivotably coupled to the link 11 via a connector 14. The frame 12 extends upwards and supports a support ring (not shown) for the kettle. The tuning rod 13 is connected at its top end to a known head tensioning mechanism (not shown).

Though only one is shown in the drawing, several (e.g. 6 to 8) tension rods 9 extend, in practice, radially outwards from the spider nut at equal angular intervals for connection with corresponding tuning rods 13 in corresponding frames 12.

At a position remote from the spider nut 8, a step 15 is formed on the outer side wall of the housing 1 and an adjuster bolt 16 extends inwards idly through the side wall of the housing 1 facing the step 15. The inner end of the adjuster bolt 16 is screwed into one closed end of a cylinder 17. One end of a balance tension rod 18 is accommodated in the cylinder 17 and provided with an end flange 18*a*. A compression spring 19 is interposed between the end flange 18*a* and the other closed end of the cylinder 17. The other end of the balance tension rod 18 is coupled to the center tuning link 3 at the second pivot 3*b* of the latter.

Figure 3:
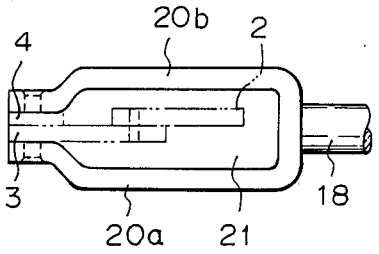
FIG. 3 is an enlarged plan view of a balance tension rod used for the tonal pitch adjuster unit shown in FIG. 1.

This coupling is better shown in FIG. 3. The end of the balance tension rod 18 is provided with a pair of parallel and spaced branches 20*a* and 20*b* whose front ends are pivoted to the center tuning link 3 and the center link 4. The lower end of the bracket 2 and the first pivot 3*a* of the center tuning link 3 are inserted into a center gap 21 between the branches 20*a* and 20*b* without any contact.

A stand 22 is formed on the top wall of the housing 1 near the step 15 and carries a foot pedal 23 at a pivot 24. On the outer side of the pivot 24 a bottom projection 25 is formed on the foot pedal whilst idly extending into the housing 1. The end of the projection 25 is pivotably coupled to one end of a tension bar 26 which almost horizontally extends below the cylinder 17 for coupling with the center tuning link 3 at the third pivot 3*c* of the latter.

When no foot pressure is applied to the foot pedal 23, the foot pedal 23 and its related parts take the position shown with solid lines and the head 16*a* of the adjuster bolt 16 is hidden below the foot pedal 23. The first and second pivots 3*a* and 3*b* of the center tuning link 3 are located on a substantially common horizontal plane. Though some extent of initial tension appears on the timpani head (not shown), no tension is applied to the head by the tonal pitch adjuster unit 30 in this position.

The tonal pitch adjuster unit 30 is accompanied with a brake unit 31 in accordance with the present invention. This brake unit 31 locks the tonal pitch adjuster unit 30 against undesirable movement which is otherwise caused by striking vibration of the head and/or momentary increased in tension of the head at strong striking. Although the brake unit 30 of this embodiment is arranged on the sliding shaft 7, the same may be arranged at any locations in the housing 1 as long as braking action is applied to the tonal pitch adjuster unit 30.

Figure 2:
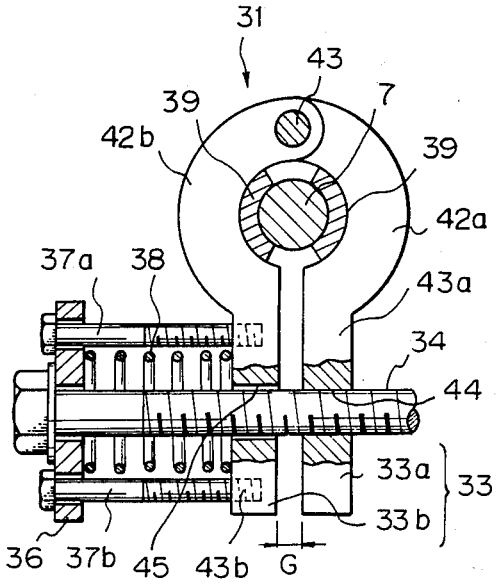
FIG.2 is an enlarged section of one embodiment of a brake unit taken along a line II—II in FIG. 1.

As best seen in FIG. 2, the brake unit 31 includes a brake arm 33 made up of a pair of cooperating blocks for clamping the sliding shaft 7 and a fastener bolt 34 for changing the gap G between the above-described cooperating blocks in order to change degree of clamp on the sliding shaft 7. The fastener bolt 34 is operable from outside the housing 1 via an operating mechanism 35 (see FIG. 1), a spring seat 36 is adjustable coupled to one of the blocks of the brake arm 33 via a pair of bolts 37*a* and 37*b*, and holds the fastener bolt 34 for free rotation. A compression spring 38 is interposed between the spring seat 36 and the brake arm 33 in order to hold the spring seat 36 in pressure contact with the heads of the pair of bolts 37*a* and 37*b*.

Each of the blocks of the brake arm 33 includes a straight section, 33(*a*) and 33(*b*) respectively, and a semi-circular section, 42*a* and 42*b* respectively. The semicircular sections 42*a* and 42*b* are coupled to each other by a pin 43 in order to firmly clamp the sliding shaft 7 via frictional members 39. One of the straight section 33*a* is provided with a thread hole 44 for screw engagement with the fastener bolt 34, while straight section 33*b* is provided with a idle hole 45 for free passage of the fastener bolt 34.

Back to FIG. 1, the operating mechanism 35 includes a shaft 46 rotatably passing through the side wall of the housing 1 and a knob 47 attached to the outer end of the shaft 46 outside the housing 1. The inner end of the shaft 46 is coupled to the fastener bolt 34 via a swivel 48.

The construction shown in FIGS. 1 to 3 operates as follows.

When the foot pedal 23 is stepped as shown with an arrow A in FIG. 1, the projection 25 turns counterclockwise in the illustration and the tension bar 26 is pulled rightwards. Then the center tuning link 3 turns as shown with an arrow B about the first pivot 3*a* on the bracket 2 and the spider nut 8 is pulled down. As a consequence the tension rods 9 are all pulled radially towards the spider nut 8 so that tension should appear on the timpani head via the tuning rod in accordance with the magnitude of the stepped angle.

Force caused by resumption of the head is passed to the second pivot 3*b* of the center tuning link 3 via the tuning rods 13, the tension rods 9 and the spider nut 8 and generates a moment to turn the center tuning link 3 clockwise about the first pivot 3*a*. As the center tuning link 3 turns, the balance tension rod 18 is pulled leftwards to press the compression sprig 19 in the cylinder 17 via the end flange 18*a*. Force caused by repulsion of the compression spring 19 is passed to the second pivot 3*b* of the center tuning link 3 and generates a moment to turn the center tuning link 3 counterclockwise about the first pivot 3*a*. Since the moment by spring repulsion balances with the moment by head resumption, the center tuning link 3 is kept at a fixed position corresponding to the stepped angle of the foot pedal 23 even after the foot pressure on the foot pedal 23 is removed.

Such a balanced condition is well retained as long as the timpani is off performance. However, when striking vibration of the head and/or force at strong striking of the head is passed to the tonal pitch adjuster unit 30 during performance, the tonal pitch adjuster unit 30 is also urged to vibrate and disturbs above-described balance of moment, thereby causing the foot pedal 23 to get out of the above-described fixed position. This displacement of the foot pedal 23 inevitably causes disorder in musical sounds to be generated.

In accordance with the present invention, the sliding shaft 7 is locked against vertical movement caused by head striking due to friction between the sliding shaft 7 and the frictional members 39 of the brake unit 31. Since the sliding shaft 7 is coupled to the tonal pitch adjuster unit 30 via the center link 4, the tonal pitch adjuster unit 30 is also locked against vibration caused by head striking.

Degree of brake action can be easily adjusted outside the housing 1 by means of the operating mechanism 35. More specifically, manual turning of the knob 47 is passed to the fastener bolt 34 via the shaft 46 and the swivel 48 which then moves the straight section 33*a* of the brake arm 33 towards and away from the straight section 33*b* to change the gap G between the two straight sections 33*a* and 33*b* of the brake arm 33.

Since the brake unit 31 is attached to the sliding shaft 7 in the case of this embodiment, one set of brake unit can span all directional resumption of the timpani head. In addition, good brake action is expected due to arrangement of the sliding shaft 7 relatively near the head.

Figure 4:
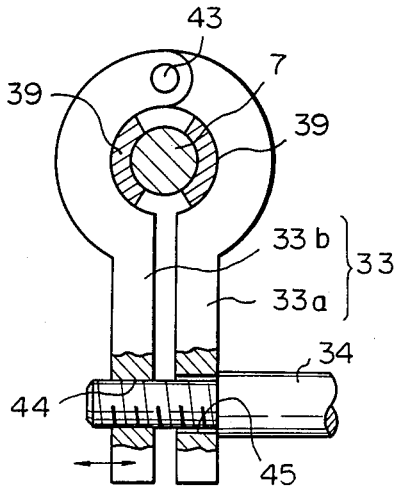
FIG. 4 is a plan view of another embodiment of the brake unit.

Another embodiment of the brake unit 31 is shown in FIG. 4, in which the spring seat 36, the bolts 37*a* and 37*b* and the compression spring 36 used for the foregoing embodiment are removed. As a substitute, the thread hole 44 is formed in the straight section 33*b* and a hole 45 for passage of the fastener bolt 34 is formed in the straight section 33*a* of the brake arm 33.

Figure 5:
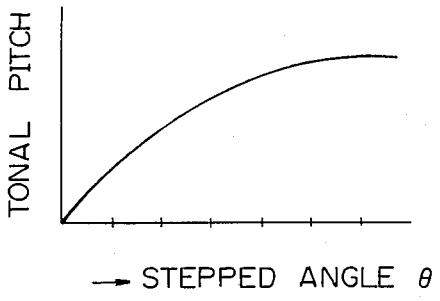
FIG. 5 is a graph for showing a relationship between the stepped angle and the tonal pitch.

In the case of the embodiment shown in FIG. 1, in which the foot pedal 23 is coupled to the center tuning link 3 via the tension bar 26, tonal pitch changes are shown in FIG. 5 depending on the degree of stepped angle $\theta$. However, the present invention is also well applicable to tonal pitch adjuster units such as disclosed in Japanese Patent Opening Sho. 53-136815 and Japanese Utility Model Opening sho. 54-46325.

I claim:

1. A timpani comprising a kettle having a head surface, head surface tensioning means adjustably interacting with said head surface for tensioning said head surface, tonal pitch adjustment means for adjusting the tension provided by said head surface tensioning means, said tonal pitch adjustment means including foot pedal means and interconnection means for interconnecting said foot pedal means with said head surface tensioning means, whereby a predetermined degree of tension is provided in said head surface from a predetermined position of said foot pedal means, said interconnection means including balancing means for retaining said predetermined degree of tension in said head surface during periods of non-use of said timpani, said balancing means including a first end connected to said head surface tensioning means, and braking means interposed between said balancing means and said head surface tensioning means and connected solely to said first end of said balancing means for maintaining said predetermined degree of tension in said head surface during periods of use of said timpani.

2. The timpani according to claim 1 wherein said braking means is frictionally connected to said interconnection means.

3. The timpani according to claim 2 including sliding shaft means affixed to said interconnection means, said braking including clamping means for frictionally clamping said sliding shaft means with a predetermined clamping force.

4. The timpani according to claim 3 wherein said braking means includes clamping force adjustment means for modifying said predetermined clamping force.

5. A timpani comprising a kettle having a head surface, head surface tensioning means adjustably interacting with said head surface for tensioning said head surface, tonal pitch adjustment means for adjusting the tension provided by said head surface tensioning means, said tonal pitch adjustment means including foot pedal means and interconnection means for interconnecting said foot pedal means with said head surface tensioning means, whereby a predetermined degree of tension is provided in said head surface from a predetermined position of said foot pedal means, said interconnections means including balancing means for retaining said predetermined degree of tension in said head surface during periods of non-use of said timpani, sliding shaft means affixed to said interconnection means, braking means interposed between said balancing means in said head surface tensioning means for maintaining said predetermined degree of tension in said head surface during periods of use of said timpani, said braking means being frictionally connected to said interconnection means, and including clamping means for frictionally clamping said sliding shaft means with a predetermined clamping force, and clamping force adjustment means for modifying said predetermined clamping force, said clamping force adjustment means including collar means, said collar means including a first collar section having a first end and a second end and a second collar section having a first end and a second end, said first ends of said first and second collar sections being pivotably interconnected and said second ends of said first and second collar sections being adjustably interconnected.

6. The timpani according to claim 5, wherein said first collar section includes a threaded receptacle at said second end and said second collar section includes an aperture at said second end, and including bolt means freely rotatable within said aperture but fixed in the direction of said threaded receptacle by said aperture threadably interconnected with said threaded receptacle.

7. The timpani according to claim 6, including rotation means for rotating said bolt means so as to modify said predetermined clamping force.

8. The timpani according to claim 7, wherein said rotation means includes knob means and knob interconnection means rotatable with said knob means form rotably interconnecting said knob means with said bolt means, whereby said knob means can be remotely located with respect to said bolt means form rotating said bolt means from said remote location.

9. A timpani comprising a kettle having a head surface, head surface tensioning means adjustably interacting with said head surface for tensioning said head surface, tonal pitch adjustment means for adjusting the tension provided by said head surface tensioning means, said tonal pitch adjustment means including foot pedal means, and interconnection means for interconnecting said foot pedal means with said head surface tensioning means whereby a predetermined degree of tension is provided in said head surface for a predetermined position of said foot pedal means, said interconnection means having a first end portion connected to said head surface tensioning means, and including balancing means for retaining said predetermined degree of tension in said head surface during periods of non-use of said timpani, independent sliding shaft means having a first end and a second end, said first end being connected to said first end of said interconnection means and adjacent said head surface tensioning means, and braking means connected to said second end of said independent sliding shaft means for maintaining said predetermined degree of tension in said head surface during periods of use of said timpani.

* * * * *

UNITED STATES PATENT AND TRADEMARK OFFICE

CERTIFICATE OF CORRECTION

PATENT NO. : 4,856,406

DATED : August 15, 1989

INVENTOR(S) : Hiroaki Ohmuro

It is certified that error appears in the above-identified patent and that said Letters Patent is hereby corrected as shown below:

Column 1, line 24, "changes" should read --change--.
Column 1, linè 35, "anti" should read --unit--.
Column 3, line 49, "sprig" should read --spring--.
Column 4, line 24, "36" should read --39--.
Column 4, line 31, "are" should read --as--.

Signed and Sealed this

Twenty-fifth Day of September, 1990

*Attest:*

HARRY F. MANBECK, JR.

*Attesting Officer*

*Commissioner of Patents and Trademarks*